United States Patent [19]

Johnson

[11] 4,027,847

[45] June 7, 1977

[54] EXPANDABLE TIE ANCHOR

[76] Inventor: Clavin R. Johnson, 1813 Juniper Drive, Alamogordo, N. Mex. 88310

[22] Filed: Mar. 26, 1976

[21] Appl. No.: 670,979

[52] U.S. Cl. ..... 249/190; 349/40; 249/216

[51] Int. Cl.[2] ..... E04G 17/08

[58] Field of Search ..... 249/40–46, 249/190–191, 213–214, 216, 217

[56] References Cited

UNITED STATES PATENTS

| | | | |
|---|---|---|---|
| 2,728,127 | 12/1955 | Armstrong | 249/217 |
| 3,430,914 | 3/1969 | Clasen et al. | 249/214 |
| 3,918,673 | 11/1975 | Abbott | 249/216 |

FOREIGN PATENTS OR APPLICATIONS

| | | | |
|---|---|---|---|
| 2,005,210 | 9/1971 | Germany | 249/42 |

*Primary Examiner*—Francis S. Husar
*Assistant Examiner*—John McQuade
*Attorney, Agent, or Firm*—Clarence A. O'Brien; Harvey E. Jacobson

[57] ABSTRACT

A tie rod is provided having an abutment on one end portion thereof spaced a predetermined distance inwardly of the terminal end of the rod. A tubular sleeve is slidably mounted on the one end portion of the rod outwardly of the abutment for endwise abutting engagement with the latter and the sleeve includes structure which renders the sleeve substantially incompressible in an axial direction, but enables the sleeve to be expanded in radial directions. A wedge sleeve is slidably mounted on the end portion of the rod outwardly of the first-mentioned sleeve and includes a tapered end portion receivable within and operative to radially expand the adjacent end of the first-mentioned sleeve. The diameter of the first-mentioned sleeve is such to be received through a bore formed in a concrete form wall and may be expanded, upon movement of the wedge sleeve theretoward, to a diameter larger than the aforementioned bore whereby the outer end of the first-mentioned sleeve will abut the inner surfaces of the form wall about the bore through which the free end portion of the rod extends.

12 Claims, 4 Drawing Figures

EXPANDABLE TIE ANCHOR

BACKGROUND OF THE INVENTION

Various forms of tie rod anchors for engaging the inner surfaces of a concrete form wall have been heretofore designed. However, most of these tie anchors have been constructed whereby they are laterally displaceable relative to the rod upon which they are disposed for engagement with the form wall inner surface on only one side of a bore in that form wall through which the associated tie rod extends. This of course does not evenly distribute the tension forces on the form wall about the bore formed therein.

BRIEF DESCRIPTION OF THE INVENTION

The form tie anchor of the instant invention comprises a sleeve which is of a diameter to be snugly received through a bore formed in a concrete form wall and which is mounted on the associated tie rod in position concentric therewith. The sleeve includes structure which renders it substantially incompressible in an axial direction, but allows the sleeve to be expanded, equally, in all radial directions whereby the end of the sleeve opposing the inner surfaces of the associated form wall may be enlarged to have an inside diameter at least equal to the diameter of the bore in the form wall through which the sleeve is receivable in an unexpanded state. In this manner, the associated form wall is strongly braced against inward displacement.

The main object of this invention is to provide a tie anchor for abutting engagement with the inner surfaces of an associated form wall and constructed in a manner whereby the anchor and associated rod may be readily preassembled.

Another object of this invention is to provide a tie anchor of the sleeve type which may be radially expanded by forces applied thereto from the exterior of an associated form wall into a diametrically enlarged condition whereby the end of the sleeve opposing the inner surface of the associated form wall will engage those portions of the inner surface extending about a bore formed in the form wall through which the associated tie rod extends.

Still another object of this invention is to provide a tie anchor including an expandable sleeve and a sliding wedge for expanding the sleeve with the sleeve and wedge removably joined together as an integral unit for initial assembly on the associated tie rod and proper initial positioning on the tie rod in relation to the associated form wall.

A final object of this invention to be specifically enumerated herein is to provide a tie anchor in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a form wall having a tie bore 12 formed therethrough.

Figure 1:
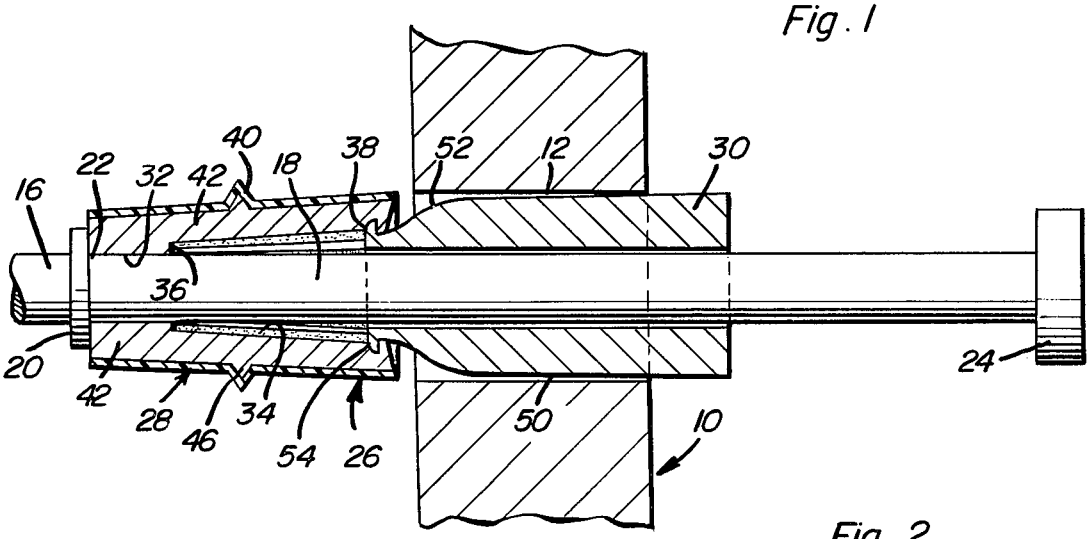
FIG. 1 is a fragmentary vertical sectional view illustrating the tie anchor of the instant invention in position assembled on an associated tie rod and with the corresponding end portion of the tie rod projecting through a bore formed in a form wall, the anchor being of the expandable type and illustrated in position immediately prior to its expansion.
Figure 2:
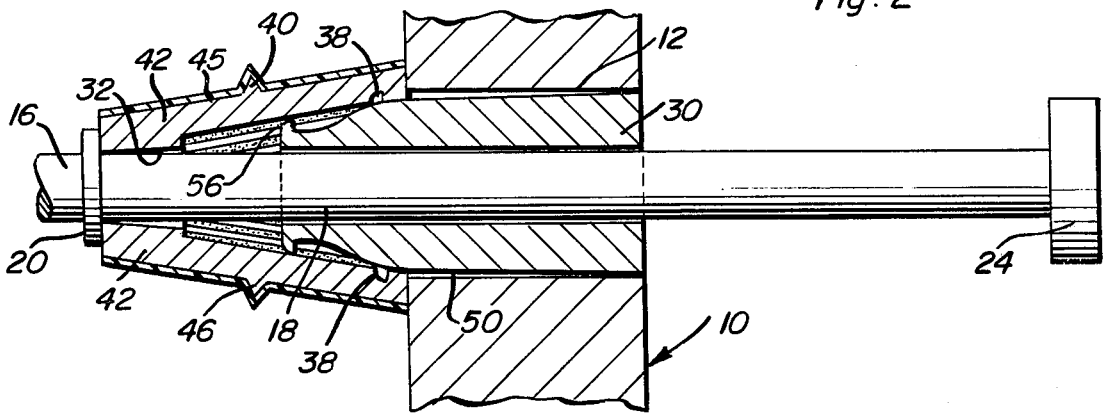
FIG. 2 is a fragmentary sectional view similar to FIG. 1 but with the expandable tie anchor illustrated in the expanded position.

A tie rod 16 is illustrated in FIGS. 1 and 2 and includes a first end portion 18 which projects through the bore 12 and is equipped with a fixed annular and radially outwardly projecting abutment 20 inwardly of the wall 10. The rod 16 includes a weakened area 22 immediately outwardly of the abutment 20 and the terminal end of the rod 16 includes a diametrically enlarged head 24 thereon.

The tie anchor of the instant invention is referred to in general by the reference numeral 26 and includes a tapered sleeve construction referred to in general by the reference numeral 28 and a combined wedge and abutment sleeve 30.

During the construction of the tie rod the abutment 20 is conventionally formed thereon and the head 24 is thereafter spun on the outer terminal end of the rod 16. However, before the head 24 is spun on the outer terminal end of the rod 16 the anchor construction or tie anchor 26 is "blown" or otherwise slidably placed onto the end portion 18 outwardly of and against the abutment 20. The sleeve 28 includes an axial bore 32 formed therethrough which snugly receives the end portion 18 and the sleeve 28 tapers toward the end thereof abutted against the abutment 20. The outer end of the bore 32 includes a counterbore 34 which tapers inwardly toward the bore 32 and defines an annular shoulder 36 at its inner end. In addition, the outer end of the counterbore 34 includes a circumferentially extending and inwardly opening groove 38. Also, the frusto-conical outer surfaces of the sleeve 28 include a circumferentially extending and radially outwardly projecting rib 40 centrally intermediate the opposite ends of the sleeve 28.

Figure 4:
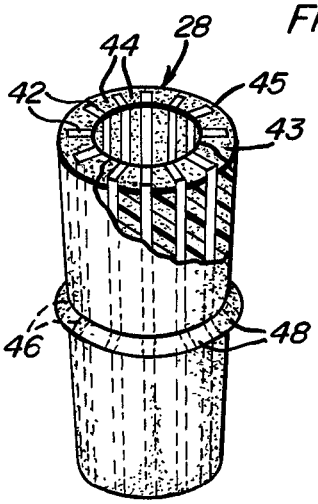
FIG. 4 is a perspective view of the expandable anchor.

With attention now invited more specifically to FIG. 4 of the drawings, it may be seen that the sleeve 28 comprises a plurality of circumferentially spaced and longitudinally extending ribs 42 embedded in and spaced about a sleeve body 43 defining a plurality of partial cylindrical sections 44 disposed between adjacent ribs 42 and including an outer peripheral layer 45 overlying the outer surfaces of the ribs 42.

The ribs 42 are constructed of any suitable material such as metal or plastic which is substantially non-compressible and the sleeve body 43 including the sections 44 and the outer layer 45 is constructed of elastomeric material of any suitable type in which the ribs 42 are bonded.

The side elevational shape of each of the ribs 42 may be readily observed from FIGS. 1 and 2 of the drawings and it will be noted that the longitudinal sectional profile of each of the partial cylindrical sections 44 is identical. Accordingly, portions of the groove 38 are formed in the ribs 42 and the remaining portions of the groove 38 are formed in the partial cylindrical sections 44. Also, the ribs 42 include projections 46 which define portions of the rib 40 and the sections 44 include projections 48 which define the remaining portions of the rib 40.

The abutment and wedge sleeve or plunger 30 includes outer surfaces 50 which are substantially cylindrical but which taper toward the sleeve 28. Further, the end portion of the wedge sleeve 30 adjacent the sleeve 28 is more sharply tapered as at 52 and has its terminal end telescoped within the outer end of the counterbore 34. In addition, the terminal end of the sleeve 30 projecting into the counterbore 34 includes a diametrically enlarged circumferentially extending rib 54 which is keyed in the groove 38 in order to removably anchor the sleeves 28 and 30 together as an integral unit. By anchoring the sleeves 28 and 30 together prior to their being assembled on the end portion 18, the assembly of the tie anchor 26 on the rod 16 may be more easily carried out in a shorter period of time whether the anchor 26 is manually assembled on the rod 16 or assembled on the rod 16 by means of production line equipment. In addition, by initially assembling the sleeves 28 and 30 the anchor construction or tie anchor 26 may be accurately positioned on the rod 16 relative to the abutment 20 and the head 24 and the tie rod 16, with the anchor 26 mounted thereon may be more readily inserted through the bore 12 into the desired position thereof illustrated in FIG. 1.

From FIG. 2 of the drawings it may be seen that the rib 54 includes a rounded surface as at 56 and that the groove 38 is of similar cross-sectional shape. Accordingly, an axial thrust may be applied to the outer end of the sleeve 30 to shift the latter toward the abutment 20 in order to unseat the rib 56 from the groove 38 and allow the more sharply tapered portion 52 of the sleeve 30 to be wedged into the outer end of the counterbore 34 in order to expand that end of the sleeve 30. Accordingly, after the tie rod 16 has been positioned relative to the wall 10 in the manner illustrated in FIG. 1 of the drawings a suitable waler bracket or the like including a cam structure (as is conventional) may be applied to the end portion of the rod 16 disposed outwardly of the wall 10 and the cam structure thereof may be actuated to force the sleeve 30 inwardly from the position thereof illustrated in FIG. 1 of the drawings to the position thereof illustrated in FIG. 2 in order to expand the outer end of the sleeve 28 so that the outer end face of the sleeve opposes the inner surfaces of the wall 10 disposed about the inner end of the bore 12. Of course, as the aforementioned waler bracket has its wedge structure actuated to force the wedge sleeve 30 inwardly, the wedge structure forces the sleeve 30 inwardly to the correct position thereof so that the outer end face of the wedge sleeve 30 is coplanar with the outer surface of the wall 10 and the rod 16 is positioned, relative to the sleeve 30, so that the outer end face of the sleeve 28 is tightly wedged against the inner surfaces of the wall 10 disposed about the inner end of the bore 12.

Inasmush as the aforementioned waler bracket is engaged with the tie rod 16 outwardly of the wall 10 and abuts the outer surface of the wall 10, outward displacement of the wall 10 relative to the rod 16 is prevented. Further, inasmuch as the outer end face of the sleeve 28 abuts the inner surfaces of the wall 10 disposed about the inner end of the bore 12 and the inner end of the sleeve 28 abuts the abutment 20, inward displacement of the wall 10 relative to the rod 16 is prevented and the wall 10 is therefore tightly braced in proper position relative to the tie rod 16. Of course, the left end of the tie rod 16 (not shown) is also equipped with a similar tie anchor corresponding to the anchor 26 bracing the inner form wall against shifting relative to the tie rod 16.

Figure 3:
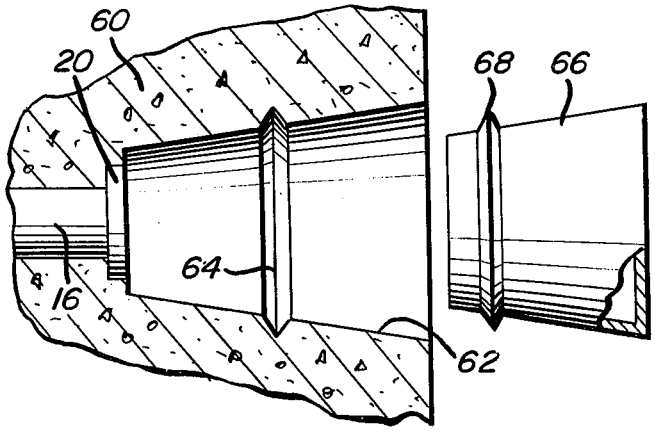
FIG. 3 is a fragmentary vertical sectional view illustrating a section of concrete wall formed through the utilization of the tie anchor and illustrating the resultant recess formed outwardly of the foreshortened tie rod after removal of the anchor and with a plastic plug for the recess illustrated in exploded position.

With attention now invited more specifically to FIG. 3 of the drawings, after the concrete wall 60 has been poured and allowed to cure the wall 10 is removed (after removal of the corresponding waler bracket) and the sleeve 28 is removed in order to expose a recess or socket 62 in the outer surface of the wall 60 concentric with the tie rod 16. Thereafter, the end portion 18 of the tie rod 16 outwardly of the abutment 20 is broken off at the weakened area 22 above referred to. Of course, the socket or recess 62 includes a circumferential groove 64 and a plug 66 constructed of stiff but somewhat resilient material and including a rib 68 is forced into the socket or recess 62 in position with the rib 68 seated within the groove 64 and therefore retaining the plug 66 in position closing the socket 62. The plug 66 is frusto-conical in configuration and is closed at its major diameter end portion. However, the plug 66 may be of hollow construction so that the inner end portion thereof from which the rib 68 is supported may be radially inwardly deflected upon insertion of the plug 66 into the recess 62 in order that the rib 68 may snap seat in the groove 64 as the plug 66 reaches a position fully seated in the outer end of the recess 62 with the large diameter end wall of the plug 66 flush with the outer surface of the wall 60.

Inasmuch as the maximum diameters of the sleeve construction 28 (when not expanded) and the wedge and abutment sleeve 30 are less than the diameter of the tie bore 12, the tie rod 16, with the sleeve construction 28 and sleeve 30 thereon, may be used in both hand setting and gang forming operations.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A form tie construction including an elongated rod having an abutment on one end portion thereof spaced a predetermined distance inwardly of the terminal end of said one end portion, a tubular circumferentially continuous sleeve slidably mounted on said one end portion outwardly of said abutment for endwise abutting engagement with the latter, said sleeve including means rendering said sleeve substantially incompressible in an axial direction thereof, but expandable in radial directions, a wedge member slidably mounted on said one end portion outwardly of said sleeve and including wedge portions thereof receivable within and operative to radially expand the adjacent end of said sleeve upon shifting of said wedge member along said rod toward said abutment.

2. The combination of claim 1 wherein said sleeve includes a wall thickness of predetermined radial extent, at least the end of said sleeve remote from said abutment being radially expandable an extent at least equal to the radial thickness of the wall of said sleeve.

3. The combination of claim 1 wherein said sleeve includes a circumferentially extending radially outwardly projecting rib intermediate its opposite ends.

4. The combination of claim 1 wherein said sleeve includes an inner circumferentially extending groove formed in the end portion thereof remote from said abutment, said wedge portions including an endwise tapering end portion on said wedge member received within said sleeve and portion remote from said abutment, said endwise tapering end portion including a circumferential rib removably seated in said groove, said endwise tapering end portion and the portions of said sleeve defining said groove defining coacting wedge surfaces operative to cam said circumferential rib out of said groove by radial expansion of said end portion of said sleeve remote from said abutment upon movement of said wedge member along said rod toward said abutment relative to said sleeve.

5. The combination of claim 1 wherein said wedge member comprises a second sleeve slidably mounted on said one end portion of said rod, the end portion of said second sleeve adjacent the first-mentioned sleeve being sharply tapered, said second sleeve being slightly tapered toward said sharply tapered end portion.

6. The combination of claim 1 wherein said sleeve includes a central bore formed therethrough in which said rod is snugly received, the end of said bore remote from said abutment including a counterbore defining an endwise outwardly opening cavity about said rod in which the adjacent portion of said wedge member is received.

7. The combination of claim 6 wherein said sleeve includes an inner circumferentially extending groove formed in the end portion thereof remote from said abutment, said wedge portions including an endwise tapering end portion on said wedge member received within said sleeve end portion remote from said abutment, said endwise tapering end portion including a circumferential rib removably seated in said groove, said endwise tapering end portion and the portions of said sleeve defining said groove defining coacting wedge surfaces operative to cam said circumferential rib out of said groove by radial expansion of said end portion of said sleeve remote from said abutment upon movement of said wedge member along said rod toward said abutment relative to said sleeve.

8. The combination of claim 1 wherein said sleeve includes a plurality of circumferentially spaced and longitudinally extending ribs constructed of material rendering said ribs at least substantially incompressible in longitudinal directions, and circumferentially spaced and longitudinally extending sleeve segments constructed of elastomeric material disposed between and interconnecting pairs of adjacent ribs.

9. The combination of claim 1 wherein said sleeve includes a circumferentially extending radially outwardly projecting rib intermediate its opposite ends, a resilient tapering plug body including a radially outwardly projecting circumferential rib intermediate its opposite ends, the longitudinal sectional shape of its plug including said rib being substantially the same as the longitudinal sectional shape of at least the end portion of said sleeve remote from said abutment including its rib when the sleeve is expanded, said plug being snap fittingly engageable in a tapered recess formed in a poured wall by said sleeve, after the sleeve has been removed from said recess.

10. The combination of claim 1 wherein the outer surfaces of said sleeve taper toward said abutment when said sleeve is in a non-radially expanded condition.

11. The combination of claim 1 including a form wall, said form wall having a tie bore formed therethrough, said one end portion of said rod projecting through said bore, said sleeve being of a diameter to be snugly received through said bore, said sleeve, when the end portion of said sleeve is remote from said abutment radially expanded, being of a diameter greater than the diameter of said bore, whereby said end portion thereof may be abutted against the inner side of said wall about said bore.

12. The combination of claim 11 wherein said wedge member also comprises a sleeve snugly receivable in said bore.

* * * * *